US008994706B2

(12) United States Patent
Hung et al.

(10) Patent No.: US 8,994,706 B2
(45) Date of Patent: Mar. 31, 2015

(54) DISPLAY PANEL AND DRIVING METHOD THEREOF

(71) Applicant: AU Optronics Corp., Hsin-Chu (TW)

(72) Inventors: Ming-Chi Hung, Hsin-Chu (TW); Yung-Jen Chen, Hsin-Chu (TW)

(73) Assignee: AU Optronics Corp., Hsin-Chu (TW)

( * ) Notice: Subject to any disclaimer, the term of this patent is extended or adjusted under 35 U.S.C. 154(b) by 52 days.

(21) Appl. No.: 13/969,601

(22) Filed: Aug. 18, 2013

(65) Prior Publication Data

US 2014/0333688 A1 Nov. 13, 2014

(30) Foreign Application Priority Data

May 8, 2013 (TW) ..... 102116425 A

(51) Int. Cl.
*G09G 3/36* (2006.01)
*G09G 5/02* (2006.01)

(52) U.S. Cl.
CPC ..... *G09G 3/3611* (2013.01)
USPC ..... 345/204; 345/87; 345/698

(58) Field of Classification Search
USPC ..... 345/204, 211, 214, 215, 209, 88, 698, 345/87
See application file for complete search history.

(56) References Cited

U.S. PATENT DOCUMENTS

2012/0320021 A1* 12/2012 Chang et al. ..... 345/211
2014/0022286 A1* 1/2014 Chen et al. ..... 345/690
2014/0285754 A1* 9/2014 Lee et al. ..... 349/106

* cited by examiner

*Primary Examiner* — Kent Chang
*Assistant Examiner* — Nelson Rosario
(74) *Attorney, Agent, or Firm* — Winston Hsu; Scott Margo

(57) ABSTRACT

A display panel includes a plurality of pixels, each of the pixels including a main sub-pixel and a secondary sub-pixel; a plurality of first scan lines, each of the first scan lines being coupled to main and secondary sub-pixels of a row of pixels; a plurality of second scan lines, each of the second scan lines being coupled to secondary sub-pixels of a row of pixels; a plurality of first data lines, each of the first data lines being coupled to main and secondary sub-pixels of (N+1)th and (N+2)th rows of pixels; a plurality of second data lines, each of the second data lines being coupled to main and secondary sub-pixels of (N+3)th and (N+4)th rows of pixels; a scan driver for turning on the main and secondary sub-pixels of the pixels; and a data driver for outputting data signals; wherein N is a multiple of 4, and N≥0.

11 Claims, 7 Drawing Sheets

DISPLAY PANEL AND DRIVING METHOD THEREOF

BACKGROUND OF THE INVENTION

1. Field of the Invention

The present invention relates to a display panel, and more particularly, to a display panel capable of improving image quality.

2. Description of the Prior Art

Because a liquid crystal display (LCD) panel has advantages of thin appearance, low power consumption, and low radiation, the liquid crystal display has been widely applied in various electronic products for panel displaying. The operation of the liquid crystal display panel is featured by varying voltage drops between opposite sides of a liquid crystal layer for twisting the angles of the liquid crystal molecules in the liquid crystal layer so that the transmittance of the liquid crystal layer can be controlled for illustrating images with the aid of light provided by a backlight module. In general, a liquid crystal display panel comprises a plurality of pixels, a scan driver, and a data driver. The data driver is configured to provide a plurality of data signals to the plurality of pixels via data lines. The scan driver is configured to output a plurality of scan signals to turn on corresponding pixels via scan lines.

When resolution of the liquid crystal display panel is higher, the scan driver needs to turn on the pixels at higher frequency, correspondingly, time for turning on the pixel is shorter. If time for turning on the pixel is insufficient, the data signals can not be written into the pixels completely, so as to affect images of the liquid crystal display panel. Especially, when the liquid crystal display panel is utilized to display 3D images, the scan driver needs to turn on the pixels at twice of the original frequency, such that time for turning on the pixel is decreased to a half of the original time. The liquid crystal display panel of the prior art may have bad image quality, or even can not display images correctly when displaying high resolution images or 3D images due to insufficient time for turning the pixels.

SUMMARY OF THE INVENTION

The present invention provides a display panel, comprising a plurality of pixels, each of the plurality of pixels comprising a main sub-pixel and a secondary sub-pixel; a plurality of first scan lines, each of the plurality of first scan lines being coupled to main and secondary sub-pixels of a row of pixels; a plurality of second scan lines, each of the plurality of second scan lines being coupled to secondary sub-pixels of a row of pixels; a plurality of first data lines, each of the plurality of first data lines being coupled to main and secondary sub-pixels of (N+1)th and (N+2)th rows of pixels; a plurality of second data lines, each of the plurality of second data lines being coupled to main and secondary sub-pixels of (N+3)th and (N+4)th rows of pixels; a scan driver, coupled to the first and second scan lines, for turning on the main and secondary sub-pixels of the pixels via the plurality of first scan lines during a first period of a frame period, and turning on the secondary sub-pixels of the pixels via the plurality of second scan lines during a second period of the frame period; and a data driver, coupled to the first and second data lines, for outputting data signals to the turned on main and secondary sub-pixels via the first and second data lines; wherein N is a multiple of 4, and N≥0.

The present invention further provides a driving method of a display panel, comprising providing a display panel comprising a plurality of pixels, a plurality of first scan lines, a plurality of second scan lines, a plurality of first data lines, a plurality of second data lines, a scan driver, and data driver, each of the plurality of pixels comprising a main sub-pixel and a secondary sub-pixel, each of the plurality of first scan lines being coupled to main and secondary sub-pixels of a row of pixels, each of the plurality of second scan lines being coupled to secondary sub-pixels of a row of pixels, each of the plurality of first data lines being coupled to main and secondary sub-pixels of (N+1)th and (N+2)th rows of pixels, each of the plurality of second data lines being coupled to main and secondary sub-pixels of (N+3)th and (N+4)th rows of pixels, wherein N is a multiple of 4, and N≥0; the scan driver turning on the main and secondary sub-pixels of the pixels via the plurality of first scan lines during a first period of a frame period; the scan driver turning on the secondary sub-pixels of the pixels via the plurality of second scan lines during a second period of the frame period; and the data driver outputting data signals to the turned on main and secondary sub-pixels via the first and second data lines.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
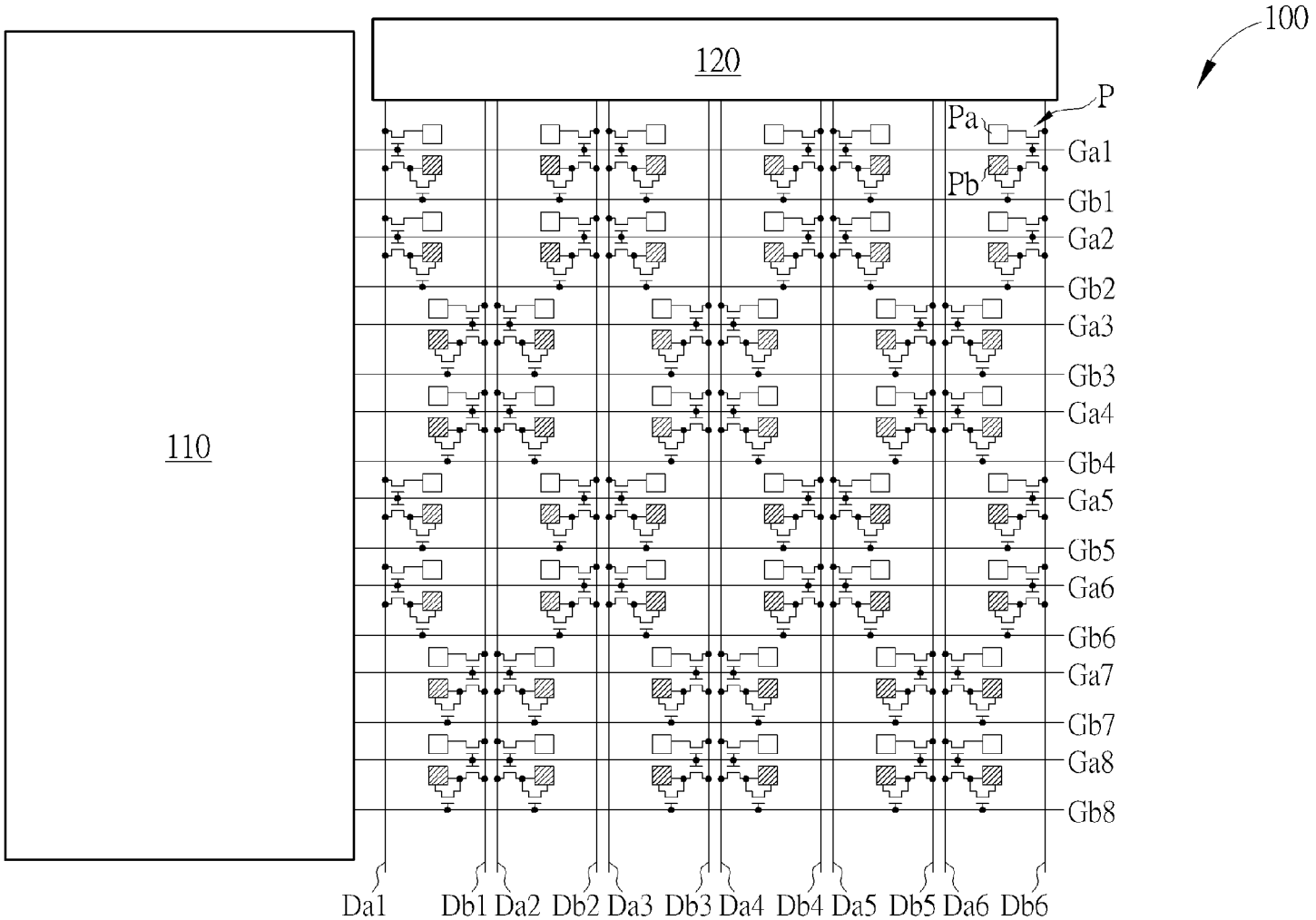
FIG. 1 is a diagram showing a display panel of the present invention.

Please refer to FIG. 1. FIG. 1 is a diagram showing a display panel of the present invention. As shown in FIG. 1, the display panel 100 of the present invention comprises a plurality of pixels P, a plurality of first scan lines Ga, a plurality of second scan lines Gb, a plurality of first data lines Da, a plurality of second data lines Db, a scan driver 110, and a data driver 120. Each of the pixels P comprises a main sub-pixel Pa and a secondary sub-pixel Pb. An area of the main sub-pixel Pa is smaller than an area of the secondary sub-pixel Pb. Each of the first scan lines is coupled to main sub-pixels Pa and secondary sub-pixels Pb of a row of pixels P. Each of the second scan lines is coupled to secondary sub-pixels Pb of a row of pixels P. Each of the first data lines Da is coupled to main sub-pixels Pa and secondary sub-pixels Pb of (N+1)th and (N+2)th rows of pixels P (N is a multiple of 4, and N≥0). Each of the plurality of second data lines is coupled to main sub-pixels Pa and secondary sub-pixels Pb of (N+3)th and (N+4)th rows of pixels P. The scan driver 110 is coupled to the first scan lines Ga and the second scan lines Gb, for turning on the main sub-pixels Pa and secondary sub-pixels Pb of a row of the pixels P via a first scan lines Ga, and turning on the secondary sub-pixels Pb of a row of the pixels P via a second scan lines Gb. The data driver 120 is coupled to the first and second data lines Da, Db, for outputting data signals to the turned on main and secondary sub-pixels Pa, Pb via the first and second data lines Da, Db.

According to the above arrangement, when the display panel 100 of the present invention displays images, the scan driver 110 can turn on the main and secondary sub-pixels Pa, Pb via the first scan lines Ga to display main images, and then on the secondary sub-pixels Pb via the second scan lines Gb to display auxiliary images, so as to improve image quality of the display panel 100. Especially when the display panel 100 of the present invention displays 3D images, the auxiliary images can improve image quality of lateral visual angle images for reducing crosstalk effect.

Figure 2:
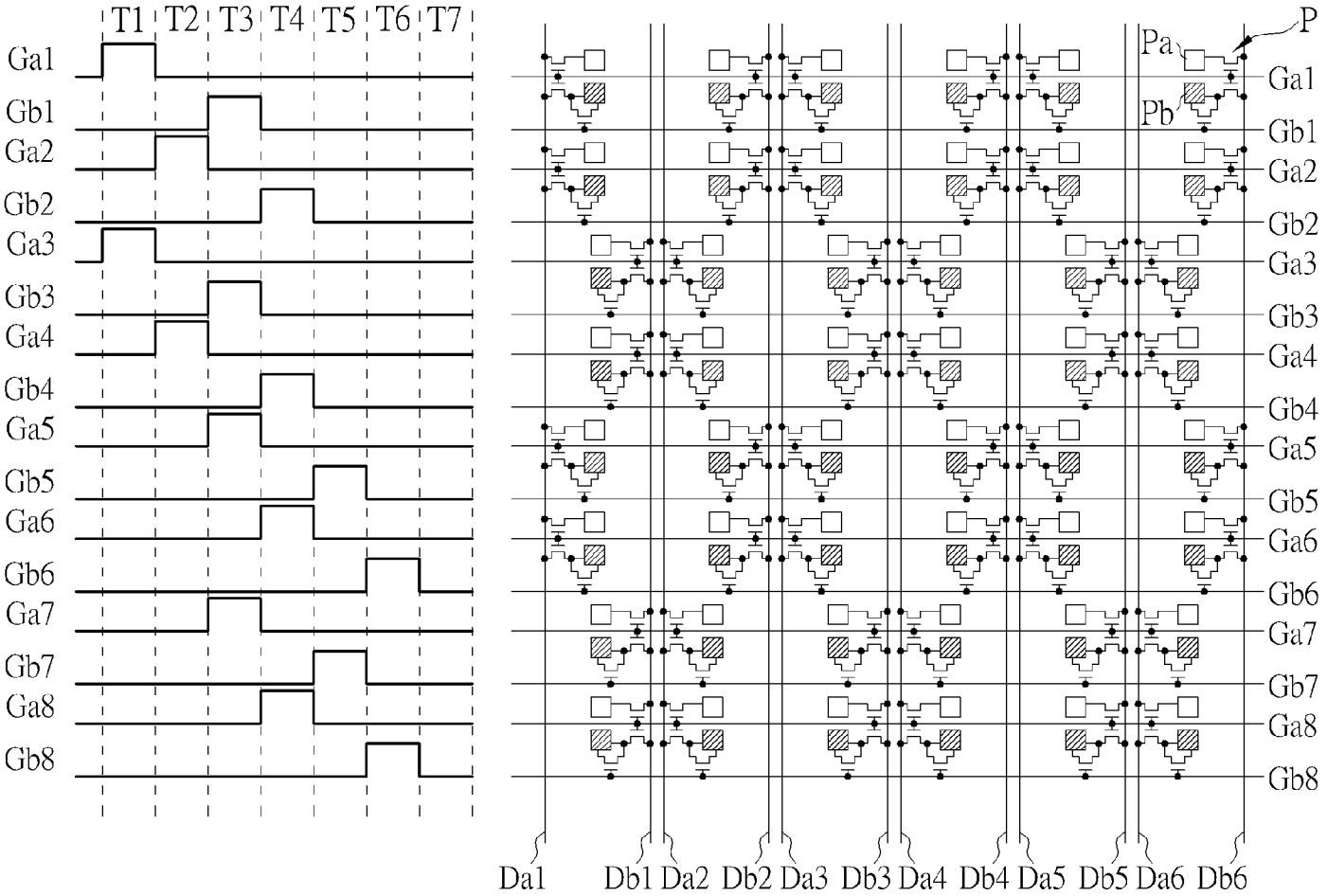
FIG. 2 is a diagram showing the display panel of the present invention driving pixels when displaying 2D images.

Please refer to FIG. 2, and refer to FIG. 1 as well. FIG. 2 is a diagram showing the display panel of the present invention driving pixels when displaying 2D images. As shown in FIG. 2, when the display panel 100 displays 2D images, the scan driver 110 is configured to turn on main and secondary sub-pixels Pa, Pb of first and third rows of the pixels P via two of the first scan lines Ga1, Ga3 during a period T1 of a frame period for displaying main images, to turn on main and secondary sub-pixels Pa, Pb of second and fourth rows of the pixels P via two of the first scan lines Ga2, Ga4 during a period T2 of the frame period for displaying main images, to turn on the secondary sub-pixels Pb of the first and third rows of the pixels P via two of the second scan lines Gb1, Gb3 during a period T3 of the frame period for displaying auxiliary images, to turn on the secondary sub-pixels Pb of the second and fourth rows of the pixels P via two of the second scan lines Gb2, Gb4 during a period T4 of the frame period for displaying auxiliary images, and so on.

In addition, time for displaying auxiliary images by the first and third rows of the pixels P is not limited to be in the period T3. Time for displaying auxiliary images by the first and third rows of the pixels P can be shifted to be in other period (such as the period T2 or the period T4) according to design requirement for better image quality. Similarly, time for displaying auxiliary images by the second and fourth rows of the pixels P is not limited to be in the period T4. Moreover, the time for displaying auxiliary images by the first and third rows of the pixels P is not limited to be before the time for displaying auxiliary images by the second and fourth rows of the pixels P.

According to the above arrangement, since the scan driver 110 can turn on two rows of pixels P during a same period, and the data driver 120 can output different data signals to pixels P at a same column but a different row, correspondingly, time for turning on the pixels can be doubled. Therefore, when the display panel 100 of the present invention displays 2D images with higher resolution, the data driver 120 has enough time to completely write the data signals into the pixels P.

Figure 3:
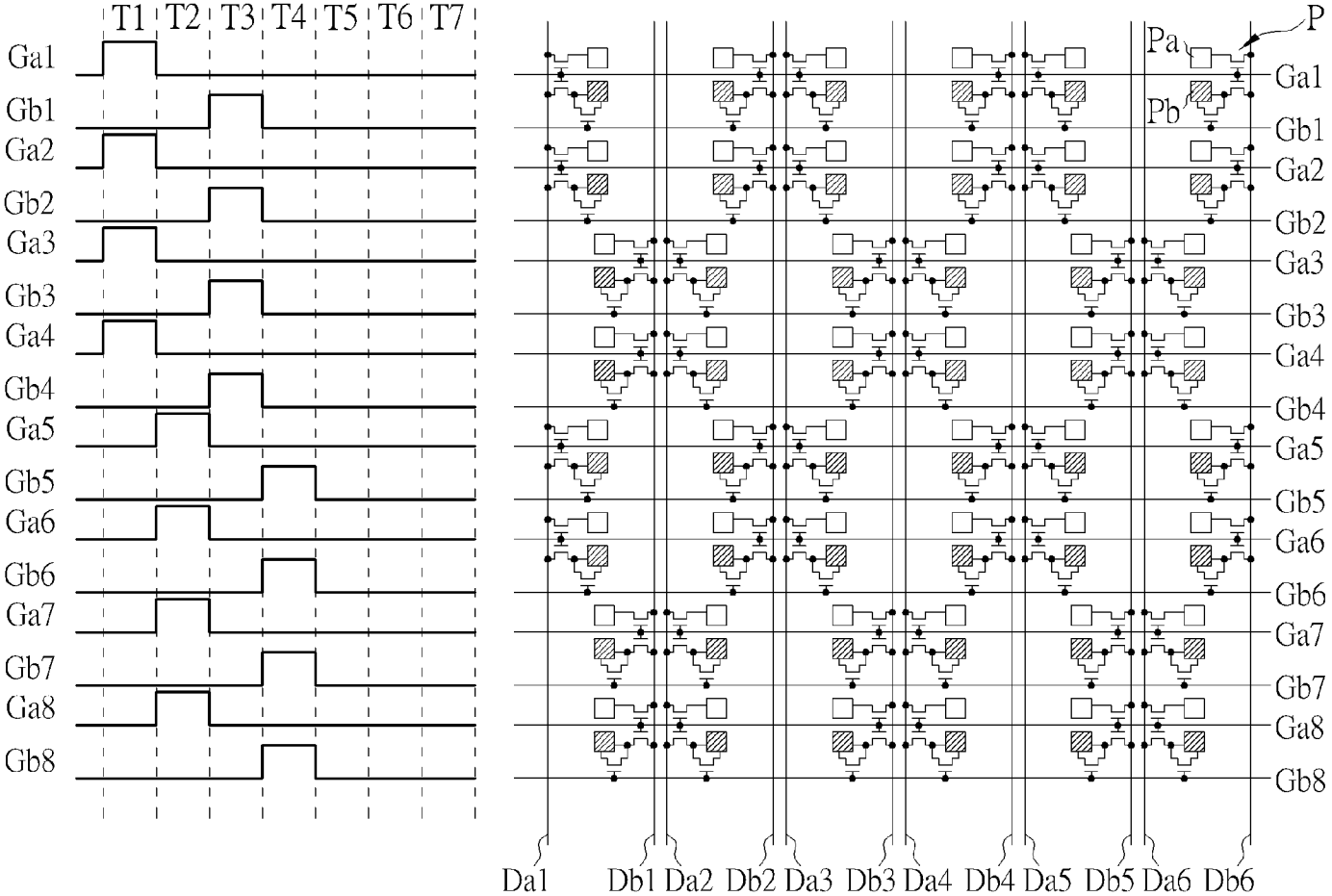
FIG. 3 is a diagram showing the display panel of the present invention driving pixels when displaying 3D images.

Please refer to FIG. 3, and refer to FIG. 1 as well. FIG. 3 is a diagram showing the display panel of the present invention driving pixels when displaying 3D images. As shown in FIG. 3, when the display panel 100 displays 3D images, the scan driver 110 is configured to turn on main and secondary sub-pixels Pa, Pb of first to fourth rows of the pixels P via four of the first scan lines Ga1-Ga4 during a period T1 of a frame period for displaying main images, to turn on main and secondary sub-pixels Pa, Pb of fifth to eighth rows of the pixels P via four of the first scan lines Ga5-Ga8 during a period T2 of the frame period for displaying main images, to turn on the secondary sub-pixels Pb of the first to fourth rows of the pixels P via four of the second scan lines Gb1-Gb4 during a period T3 of the frame period for displaying auxiliary images, to turn on the secondary sub-pixels Pb of the fifth to eighth rows of the pixels P via four of the second scan lines Gb5-Gb8 during a period T4 of the frame period for displaying auxiliary images, and so on.

In addition, time for displaying auxiliary images by the first to fourth rows of the pixels P is not limited to be in the period T3. Time for displaying auxiliary images by the first to fourth rows of the pixels P can be shifted to be in other period (such as the period T2 or the period T4) according to design requirement for better image quality. Similarly, time for displaying auxiliary images by the fifth to eighth rows of the pixels P is not limited to be in the period T4. Moreover, the time for displaying auxiliary images by the first to fourth rows of the pixels P is not limited to be before the time for displaying auxiliary images by the fifth to eighth rows of the pixels P.

According to the above arrangement, the scan driver 110 can turn on four rows of pixels P during a same period, and the data driver 120 can output data signals to two rows of pixels P via the first data lines Da, and output data signals to another two rows of pixels P via the second data lines during the same period. Therefore, when the display panel 100 of the present invention is utilized to display 3D images, even the scan driver 110 needs to turn on the pixels P at twice of the original frequency, time for turning on the pixels P still can be doubled. Therefore, when the display panel 100 of the present invention displays 3D images, the data driver 120 has enough time to completely write the data signals into the pixels P.

In addition, when the display panel 100 displays 3D images, original resolution (ex. 1920×1080) of left visual images and right visual images is roughly equal to one fourth of resolution of the display panel (ex. 3840×2160). The data driver 120 can generate data signals with larger vertical resolution (2160) according to data signals with the original vertical resolution (1080), and outputs the data signals with larger vertical resolution via the first data lines Da and the second data lines Db to drive two up-down adjacent pixels to display a same image, such that the resolution of the left visual images and the right visual images can be enlarged to the resolution of the display panel according to original scale.

Figure 4:
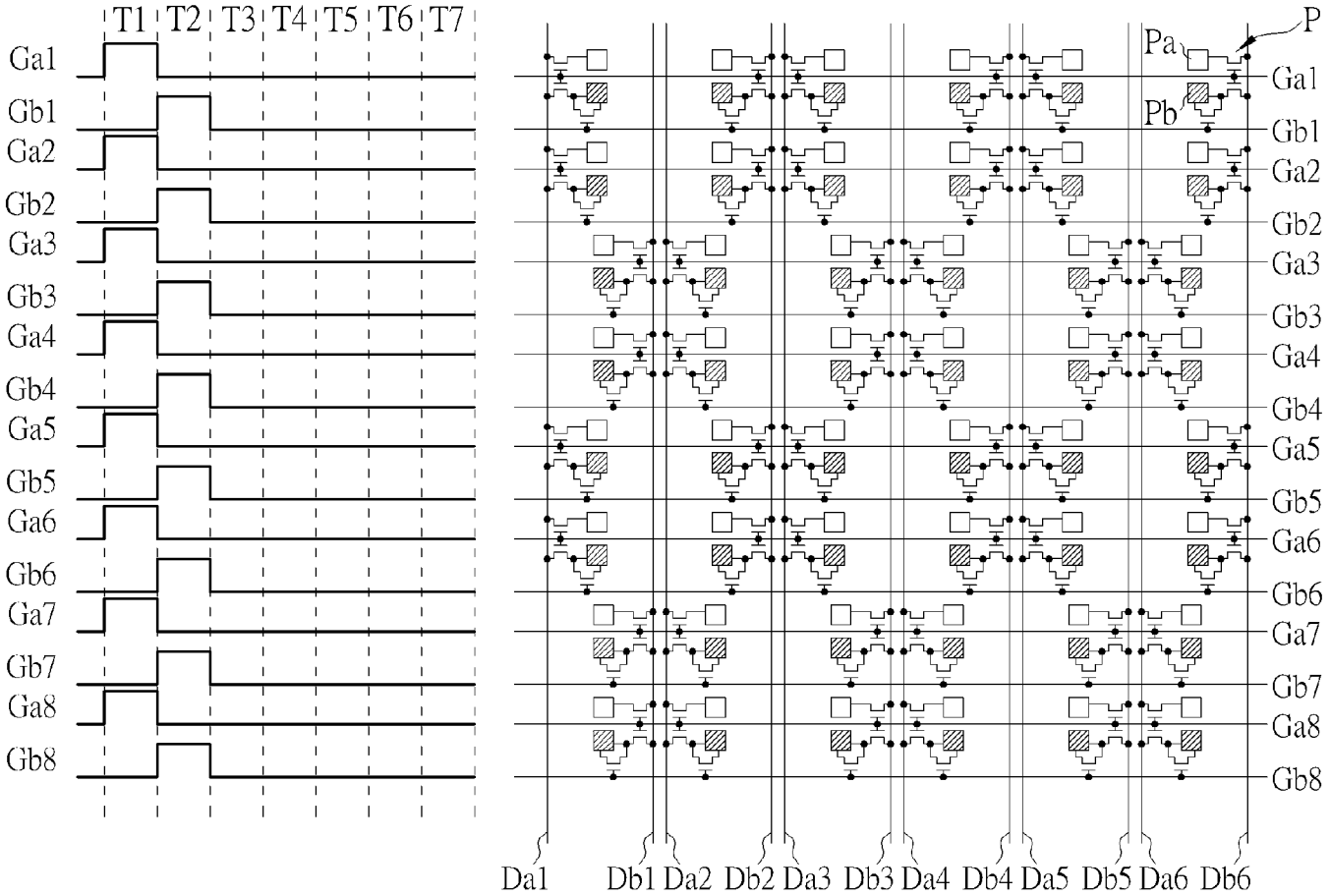
FIG. 4 is a diagram showing another embodiment of the display panel of the present invention driving pixels when displaying 3D images.

Please refer to FIG. 4. FIG. 4 is a diagram showing another embodiment of the display panel of the present invention driving pixels when displaying 3D images. As shown in FIG. 4, when the display panel 100 displays 3D images, the scan driver 110 can turn on main and secondary sub-pixels Pa, Pb of eight rows of the pixels P via eight of the first scan lines (such as Ga1-Ga8) during a period (such as the period T1) of the frame period, and turn on secondary sub-pixels Pb of the eight rows of the pixels P via eight of the second scan lines (such as Gb1-Gb8) during another period (such as the period T2) of the frame period.

According to the above arrangement, when the display panel 100 displays 3D images, time for turning on the pixels P can be quadrupled. Therefore, the display panel 100 of the present invention has enough time for charging, so as to display 3D images with higher resolution (such as resolution of 8K4K), and improve the crosstalk effect.

Figure 5:
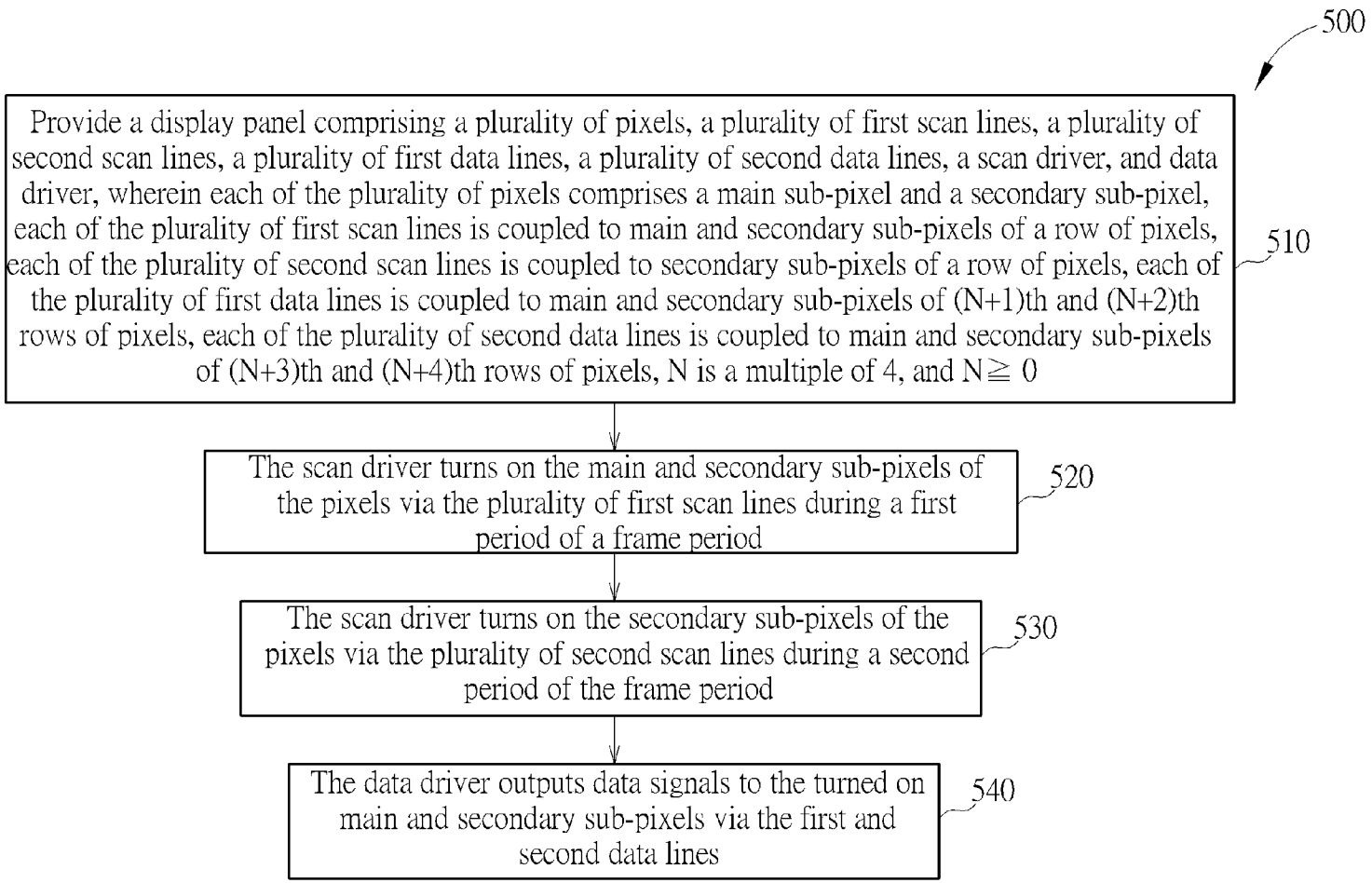
FIG. 5 is a flowchart showing a driving method of the display panel of the present invention.

Please refer to FIG. 5. FIG. 5 is a flowchart 500 showing a driving method of the display panel of the present invention. The flowchart of the driving method of the display panel of the present invention comprises the following steps:

Step 510: Provide a display panel comprising a plurality of pixels, a plurality of first scan lines, a plurality of second scan lines, a plurality of first data lines, a plurality of second data lines, a scan driver, and data driver, wherein each of the plurality of pixels comprises a main sub-pixel and a secondary sub-pixel, each of the plurality of first scan lines is coupled to main and secondary sub-pixels of a row of pixels, each of the plurality of second scan lines is coupled to secondary sub-pixels of a row of pixels, each of the plurality of first data lines is coupled to main and secondary sub-pixels of (N+1)th and (N+2)th rows of pixels, each of the plurality of second data lines is coupled to main and secondary sub-pixels of (N+3)th and (N+4)th rows of pixels, N is a multiple of 4, and N≥0;

Step 520: The scan driver turns on the main and secondary sub-pixels of the pixels via the plurality of first scan lines during a first period of a frame period;

Step 530: The scan driver turns on the secondary sub-pixels of the pixels via the plurality of second scan lines during a second period of the frame period; and Step 540: The data driver outputs data signals to the turned on main and secondary sub-pixels via the first and second data lines.

Figure 6:
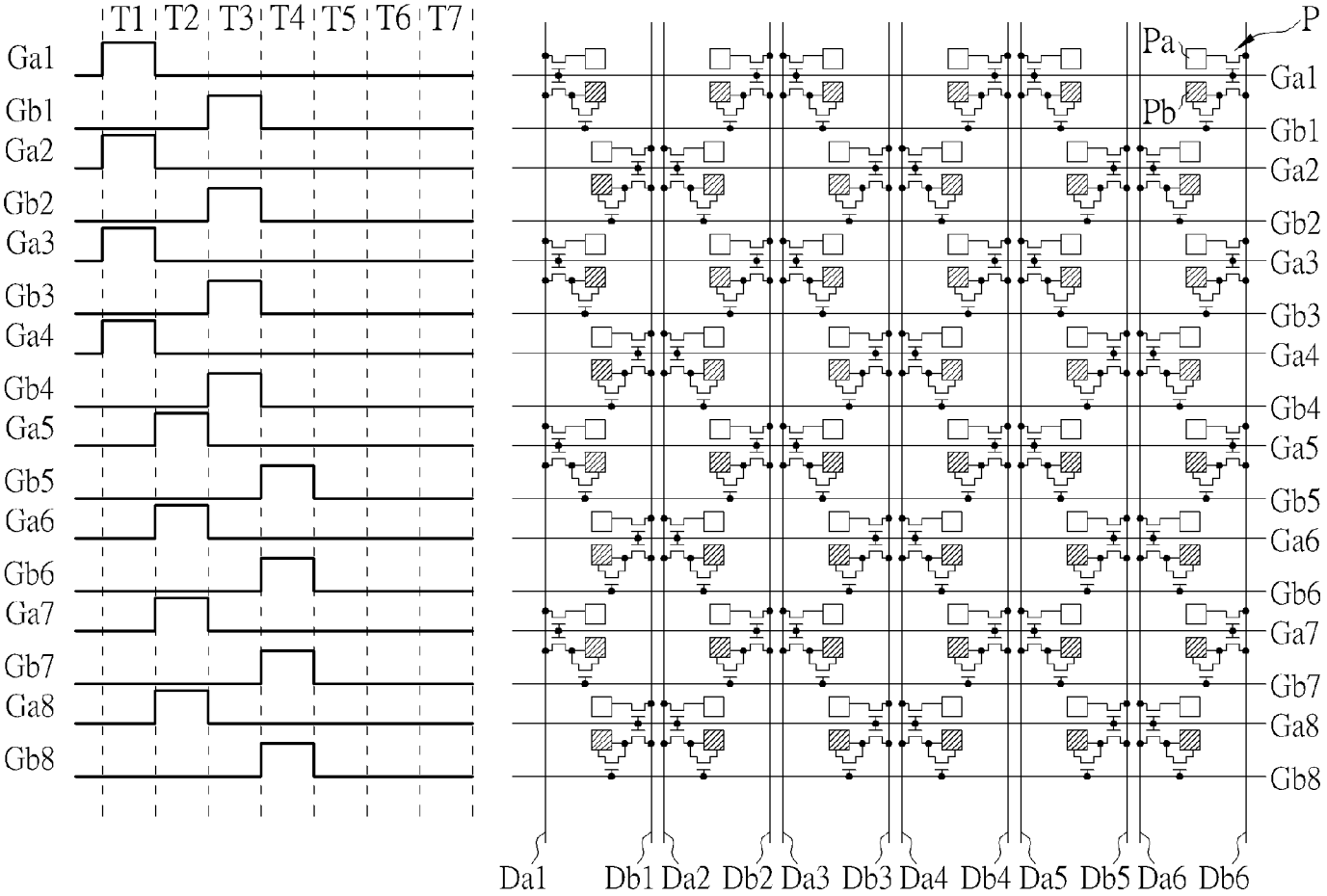
FIG. 6 is a diagram showing another embodiment of the display panel of the present invention driving pixels when displaying 3D images.

Please refer to FIG. 6. FIG. 6 is a diagram showing another embodiment of the display panel of the present invention driving pixels when displaying 3D images. As shown in FIG. 6, different from the above embodiments, in the display panel of FIG. 6, each of the first data lines Da is coupled to main and secondary sub-pixels of odd rows of pixels, and each of the plurality of second data lines Db is coupled to main and secondary sub-pixels of even rows of pixels. When the display panel displays 3D images, the scan driver 110 can turn on the main and secondary sub-pixels Pa, Pb of four rows of the pixels P via four (or multiple of 4) of the first scan lines (such as Ga1-Ga4) during a period (such as the period T1) of a frame period, and turn on the secondary sub-pixels Pb of the four rows of the pixels P via four (or multiple of 4) of the second scan lines (such as Gb1-Gb4) during another period (such as the period T3) of the frame period.

According to the above arrangement, since the scan driver 110 can turn on four rows of pixels P during a same period, and the data driver 120 can output data signals to two rows of pixels P via the first data lines Da, and output data signals to another two rows of pixels P via the second data lines during the same period, thus, time for turning on the pixels can be increased. Therefore, when the display panel 100 of the present invention is utilized to display 3D images, the data driver 120 has enough time to completely write the data signals into the pixels P.

Figure 7:
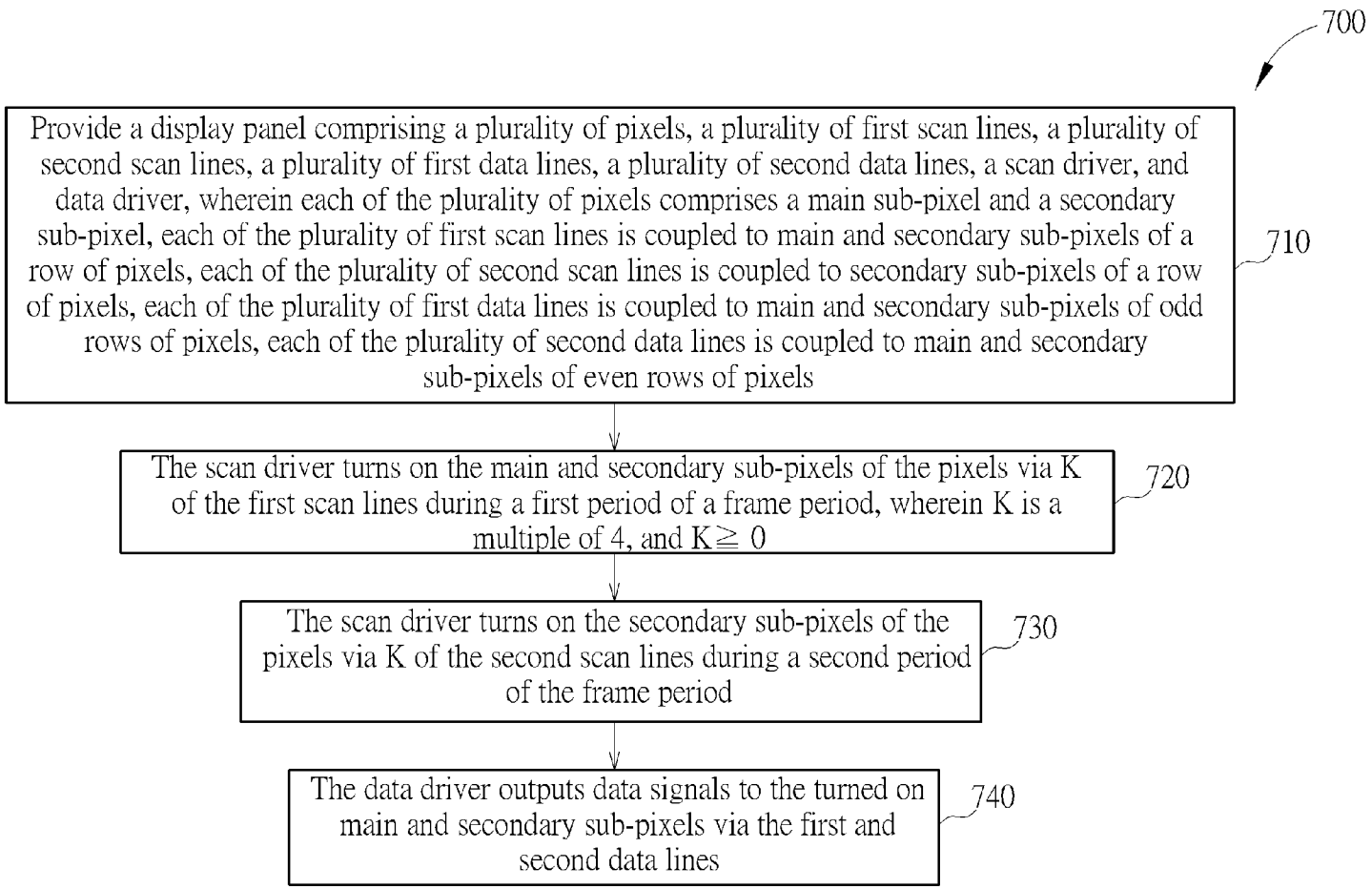
FIG. 7 is a flowchart showing another driving method of the display panel of the present invention.

Please refer to FIG. 7. FIG. 7 is a flowchart 700 showing another driving method of the display panel of the present invention. The flowchart of another driving method of the display panel of the present invention comprises the following steps:

Step 710: Provide a display panel comprising a plurality of pixels, a plurality of first scan lines, a plurality of second scan lines, a plurality of first data lines, a plurality of second data lines, a scan driver, and data driver, wherein each of the plurality of pixels comprises a main sub-pixel and a secondary sub-pixel, each of the plurality of first scan lines is coupled to main and secondary sub-pixels of a row of pixels, each of the plurality of second scan lines is coupled to secondary sub-pixels of a row of pixels, each of the plurality of first data lines is coupled to main and secondary sub-pixels of odd rows of pixels, each of the plurality of second data lines is coupled to main and secondary sub-pixels of even rows of pixels;

Step 720: The scan driver turns on the main and secondary sub-pixels of the pixels via K of the first scan lines during a first period of a frame period, wherein K is a multiple of 4, and K≥0;

Step 730: The scan driver turns on the secondary sub-pixels of the pixels via K of the second scan lines during a second period of the frame period; and Step 740: The data driver outputs data signals to the turned on main and secondary sub-pixels via the first and second data lines.

In contrast to the prior art, the display panel of the present invention can increase time for turning on the pixels when displaying high resolution images or 3D images. Therefore, the data driver of the present invention has enough time to completely write the data signals into the pixels, so as to improve image quality.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A display panel, comprising:

a plurality of pixels, each of the plurality of pixels comprising a main sub-pixel and a secondary sub-pixel;

a plurality of first scan lines, each of the plurality of first scan lines being coupled to main and secondary sub-pixels of a row of pixels;

a plurality of second scan lines, each of the plurality of second scan lines being coupled to secondary sub-pixels of a row of pixels;

a plurality of first data lines, each of the plurality of first data lines being coupled to main and secondary sub-pixels of (N+1)th and (N+2)th rows of pixels;

a plurality of second data lines, each of the plurality of second data lines being coupled to main and secondary sub-pixels of (N+3)th and (N+4)th rows of pixels;

a scan driver, coupled to the first and second scan lines, for turning on the main and secondary sub-pixels of the pixels via the plurality of first scan lines during a first period of a frame period, and turning on the secondary sub-pixels of the pixels via the plurality of second scan lines during a second period of the frame period; and a data driver, coupled to the first and second data lines, for outputting data signals to the turned on main and secondary sub-pixels via the first and second data lines;

wherein N is a multiple of 4, and N≥0.

2. The display panel of claim 1, wherein the scan driver is configured to turn on main and secondary sub-pixels of four rows of the pixels via four of the first scan lines during the first period of the frame period, and turn on the secondary sub-pixels of the four rows of the pixels via four of the second scan lines during the second period of the frame period.

3. The display panel of claim 1, wherein the scan driver is configured to turn on main and secondary sub-pixels of two rows of the pixels via two of the first scan lines during the first period of the frame period, turn on the secondary sub-pixels of the two rows of the pixels via two of the second scan lines during the second period of the frame period, turn on main and secondary sub-pixels of another two rows of the pixels via another two of the first scan lines during a third period of the frame period, and turn on the secondary sub-pixels of the another two rows of the pixels via another two of the second scan lines during a fourth period of the frame period.

4. The display panel of claim 1, wherein the scan driver is configured to turn on main and secondary sub-pixels of eight rows of the pixels via eight of the first scan lines during the first period of the frame period, and turn on the secondary sub-pixels of the eight rows of the pixels via eight of the second scan lines during the second period of the frame period.

5. The display panel of claim 1, wherein an area of the main sub-pixel is smaller than an area of the secondary sub-pixel.

6. A driving method of a display panel, comprising:

providing a display panel comprising a plurality of pixels, a plurality of first scan lines, a plurality of second scan lines, a plurality of first data lines, a plurality of second data lines, a scan driver, and data driver, each of the plurality of pixels comprising a main sub-pixel and a secondary sub-pixel, each of the plurality of first scan lines being coupled to main and secondary sub-pixels of a row of pixels, each of the plurality of second scan lines being coupled to secondary sub-pixels of a row of pixels, each of the plurality of first data lines being coupled to main and secondary sub-pixels of (N+1)th and (N+2)th rows of pixels, each of the plurality of second data lines being coupled to main and secondary sub-pixels of (N+3)th and (N+4)th rows of pixels, wherein N is a multiple of 4, and N≥0;

the scan driver turning on the main and secondary sub-pixels of the pixels via the plurality of first scan lines during a first period of a frame period;

the scan driver turning on the secondary sub-pixels of the pixels via the plurality of second scan lines during a second period of the frame period; and the data driver outputting data signals to the turned on main and secondary sub-pixels via the first and second data lines.

7. The driving method of claim 6, wherein the scan driver is configured to turn on main and secondary sub-pixels of four rows of the pixels via four of the first scan lines during the first period of the frame period, and turn on the secondary sub-pixels of the four rows of the pixels via four of the second scan lines during the second period of the frame period.

8. The driving method of claim 6, wherein the scan driver is configured to turn on main and secondary sub-pixels of two rows of the pixels via two of the first scan lines during the first period of the frame period, turn on the secondary sub-pixels of the two rows of the pixels via two of the second scan lines during the second period of the frame period, turn on main and secondary sub-pixels of another two rows of the pixels via another two of the first scan lines during a third period of the frame period, and turn on the secondary sub-pixels of the another two rows of the pixels via another two of the second scan lines during a fourth period of the frame period.

9. The driving method of claim 6, wherein the scan driver is configured to turn on main and secondary sub-pixels of eight rows of the pixels via eight of the first scan lines during the first period of the frame period, and turn on the secondary sub-pixels of the eight rows of the pixels via eight of the second scan lines during the second period of the frame period.

10. The driving method of claim 6 further comprising the data driver generating data signals with first resolution according to data signals with second resolution smaller than the first resolution, wherein the data driver outputting the data signals via the first and second data lines is the data driver outputting the data signals with the first resolution via the first and second data lines.

11. A driving method of a display panel, comprising:

providing a display panel comprising a plurality of pixels, a plurality of first scan lines, a plurality of second scan lines, a plurality of first data lines, a plurality of second data lines, a scan driver, and data driver, each of the plurality of pixels comprising a main sub-pixel and a secondary sub-pixel, each of the plurality of first scan lines being coupled to main and secondary sub-pixels of a row of pixels, each of the plurality of second scan lines being coupled to secondary sub-pixels of a row of pixels, each of the plurality of first data lines being coupled to main and secondary sub-pixels of odd rows of pixels, each of the plurality of second data lines being coupled to main and secondary sub-pixels of even rows of pixels;

turning on the main and secondary sub-pixels of the pixels via K of the first scan lines during a first period of a frame period, wherein K is a multiple of 4, and K≥0;

turning on the secondary sub-pixels of the pixels via K of the second scan lines during a second period of the frame period; and outputting data signals to the turned on main and secondary sub-pixels via the first and second data lines.

* * * * *